US008365747B1

(12) United States Patent
Su

(10) Patent No.: US 8,365,747 B1
(45) Date of Patent: Feb. 5, 2013

(54) SHAFT STRUCTURE OF AUTOMATIC UMBRELLA

(76) Inventor: Peter Su, Hsinchu (TW)

( * ) Notice: Subject to any disclaimer, the term of this patent is extended or adjusted under 35 U.S.C. 154(b) by 0 days.

(21) Appl. No.: 13/205,601

(22) Filed: Aug. 8, 2011

(51) Int. Cl.
*A45B 25/16* (2006.01)

(52) U.S. Cl. ..... 135/24; 135/22; 135/25.1

(58) Field of Classification Search ..... 135/22, 135/24, 25.1, 25.4, 28, 40, 41
See application file for complete search history.

(56) References Cited

U.S. PATENT DOCUMENTS 5,806,545 A * 9/1998 Ko ..... 135/24
5,823,215 A * 10/1998 Chou et al. ..... 135/24
5,992,433 A * 11/1999 Chung-Kuang et al. ..... 135/24
6,112,755 A * 9/2000 Lin et al. ..... 135/24
6,145,522 A * 11/2000 Ko ..... 135/24
6,173,722 B1 * 1/2001 Ko ..... 135/22
6,684,893 B2 * 2/2004 Kuo ..... 135/24
7,735,498 B2 * 6/2010 You ..... 135/24
2005/0257817 A1 * 11/2005 Kuo ..... 135/24

* cited by examiner

*Primary Examiner* — Winnie Yip
(74) *Attorney, Agent, or Firm* — C. G. Mersereau; Nikolai & Mersereau, P.A.

(57) ABSTRACT

The present invention provides a structure of shaft of automatic umbrella, which includes a shaft assembly including a second section having a top end fixed to an internal plug. An inner tube is fixed at a top end thereof to the internal plug and receives therein an operation tube having a bottom coupled to an operation plug. The inner tube receives in a top portion thereof a pulley around which an operation cable wraps. An end of the operation cable is fixed to the bullet-like member and an opposite end fixed to the operation plug. To open the umbrella, a push button is depressed and an expansion spring pushes upward the second section so that the runner cable and the operation cable drive the runner and a third shaft section upward to completely open the umbrella.

3 Claims, 4 Drawing Sheets

SHAFT STRUCTURE OF AUTOMATIC UMBRELLA

(a) TECHNICAL FIELD OF THE INVENTION

The present invention generally relates to an improved structure of automatic umbrella, and more particularly to an improvement made on a shaft assembly of the automatic umbrella, so that the improved automatic umbrella allows of an easier and more efficient operation of a last stage of compressing and closing the umbrella thereby remarkably reducing the potential risk caused in compressing and closing the umbrella.

(b) DESCRIPTION OF THE PRIOR ART

An early automatic umbrella comprises a control structure and operated in such a way as disclosed in U.S. Pat. No. 6,684,893B2. Such a known umbrella control structure is arranged inside a handle and comprises a hollow main body receiving therein a control ring. A control bar is rotatably attached to the bottom of one side of the control ring. A push button is arranged at one side of the main body and is exposed through a side opening of the handle. Expansion and collapse of the shaft of the umbrella is controlled through the above described arrangement. However, such an automatic umbrella shows a major drawback in the process of compressing and closing the umbrella, for closing umbrella requires an operation of compressing an expansion spring arranged inside the shaft of the umbrella. The expansion spring has an overall length substantially corresponding to the total length of three sections of the shaft and this render the expansion spring an elongate elastic element that shows high strength and large spring force. Consequently, a user's hand must apply a great effort to compress and close the umbrella and must have this done in a single operation. Incaution or negligence in the application of force or compression often lead to accidental release of the expansion spring that springs the shaft back to cause damage of the hand or other body portion of the user. In summary, the known automatic umbrella shows several shortcomings in practical use, which briefly described as follows:

(1) Depressing the push button to close the umbrella can only collapse the umbrella ribs and the canopy carried thereby, but the shaft still maintains the fully expanded condition with all the three sections thereof extended to the extremes. This makes it difficult for a woman or a young child whose hands are usually short to tightly grip and depress the shaft toward the handle.

(2) Since the length of the expansion spring spans from the first section to the third section of the shaft, such a great length imposes a great strength and spring force to the spring. A user must apply a great force with his or her hands to compress and close the umbrella. This makes compressing and closing the umbrella a difficult operation for a woman or a young child whose hands are generally less strong and powerful.

(3) Due to the great strength and spring force of the expansion spring, any incaution or negligence occurring in the application of force to compress and close the umbrella may lead to undesired spring back of the shaft by the released great spring force of the expansion spring. This may cause physical injuries to the hands or other body portions of the user.

Apparently, the known automatic umbrella is generally imperfect in respect of the structural arrangement thereof and may cause inconvenience and danger in operating the umbrella. Improvement is desired to overcome such problems.

SUMMARY OF THE INVENTION

The primary objective of the present invention is to alleviate or overcome the deficiencies of the known structure of automatic umbrella by providing a novel structure of shaft of automatic umbrella, in which an operation cable is arranged to pull an operation tube that is arranged inside an inner tube to push up a top cap in opening the umbrella, thereby extending a third shaft section, and to telescopically receive the third shaft section and a second shaft section together in order to allow of easy and efficient compression and closing of the umbrella.

Another objective of the present invention is to provide a structure of shaft of umbrella, in which an internal plug is fixed to a top end of the second shaft section to support the expansion spring so that the length of the expansion spring is reduced and the strength and spring force of the expansion spring are reduced, but is still operable to fully expand the shaft assembly, whereby the potential risk of a user being physically injured in the process of compressing and closing the umbrella.

To achieve the above objectives, the present invention provides a structure of shaft of automatic umbrella, wherein an improvement is made on the structure of a shaft assembly. The shaft assembly comprises a second section having a top end fixed to an internal plug. An inner tube is fixed at a top end thereof to the internal plug and receives therein an operation tube having a bottom coupled to an operation plug. The inner tube receives in a top portion thereof a pulley around which an operation cable wraps. An end of the operation cable is fixed to the bullet-like member and an opposite end fixed to the operation plug.

With such an arrangement, to open the umbrella, a push button is depressed and an expansion spring pushes upward the second section so that the runner cable and the operation cable respectively drive the runner and a third shaft section upward to completely open the umbrella. To close the umbrella, the push button is depressed again, and the operation cable is relaxed. Collapse springs drive downward movements of the runner and the third shaft section to completely telescope the third shaft section over the second shaft section thereby shortening the overall length of the shaft assembly for easy and efficient completion of the final stage of the process of compressing and closing the umbrella.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
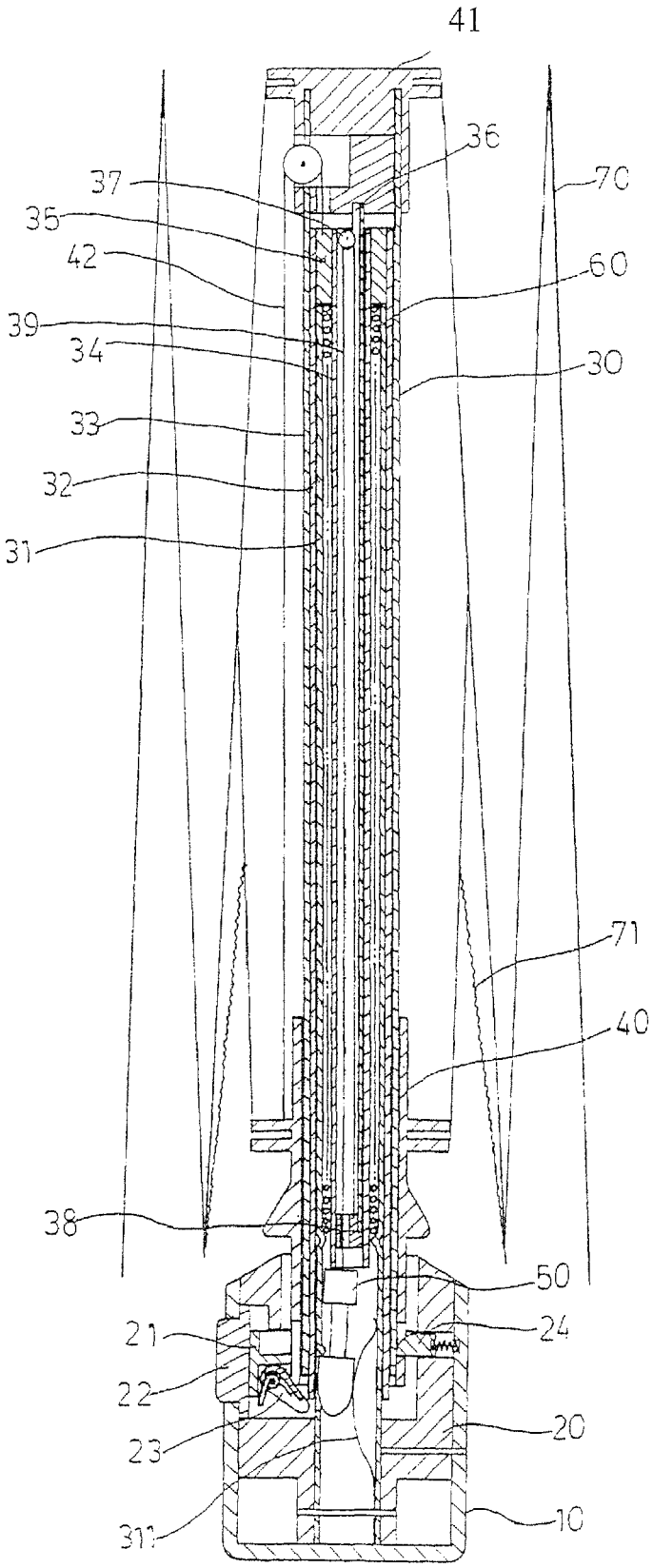
FIG. 1 is a cross-sectional view of an umbrella according to the present invention in a compressed and ready-to-use condition.

Referring to FIG. 1, a shaft structure of automatic umbrella according to an embodiment of the present invention will be described by taking a three-fold umbrella as an example. The umbrella according to the present invention generally comprises a handle (10), an operation and control unit (20), a shaft assembly (30), a runner (40), a top cap (41), a bullet-like member (50), an expansion spring (60), and a plurality of ribs (70) and collapse springs (71). The operation and control unit (20) is arranged inside the handle (10) and comprises a hollow main body that receives therein a control ring (21) and a push button (22) that is arranged inside an opening defined in a sidewall of the handle (10) and exposed outside the handle. The control ring (21) comprises a control bar (23) arranged at the bottom of one side thereof and the control ring (21) also comprises a projecting bar (24) arranged at an opposite side thereof for engaging and releasably retaining the runner (40) to hold the umbrella in a collapsed condition. The shaft assembly (30) comprises a first shaft section (31), a second shaft section (32), and a third shaft section (33) that are telescopically received in each other. The third shaft section (33) has a top end to which and the top cap (41) is fixed. The second shaft section (32) has a top portion receiving and fixing therein an internal plug (35) that fixes an inner tube (34). The first shaft section (31) of the shaft assembly (30) has a bottom end fixed to the main body of the operation and control unit (20). The expansion spring (60) is received inside the first shaft section (31) and the second shaft section (32) of the shaft assembly (30). Each of the ribs (70) is coupled between the runner (40) and the top cap (41).

Figure 2:
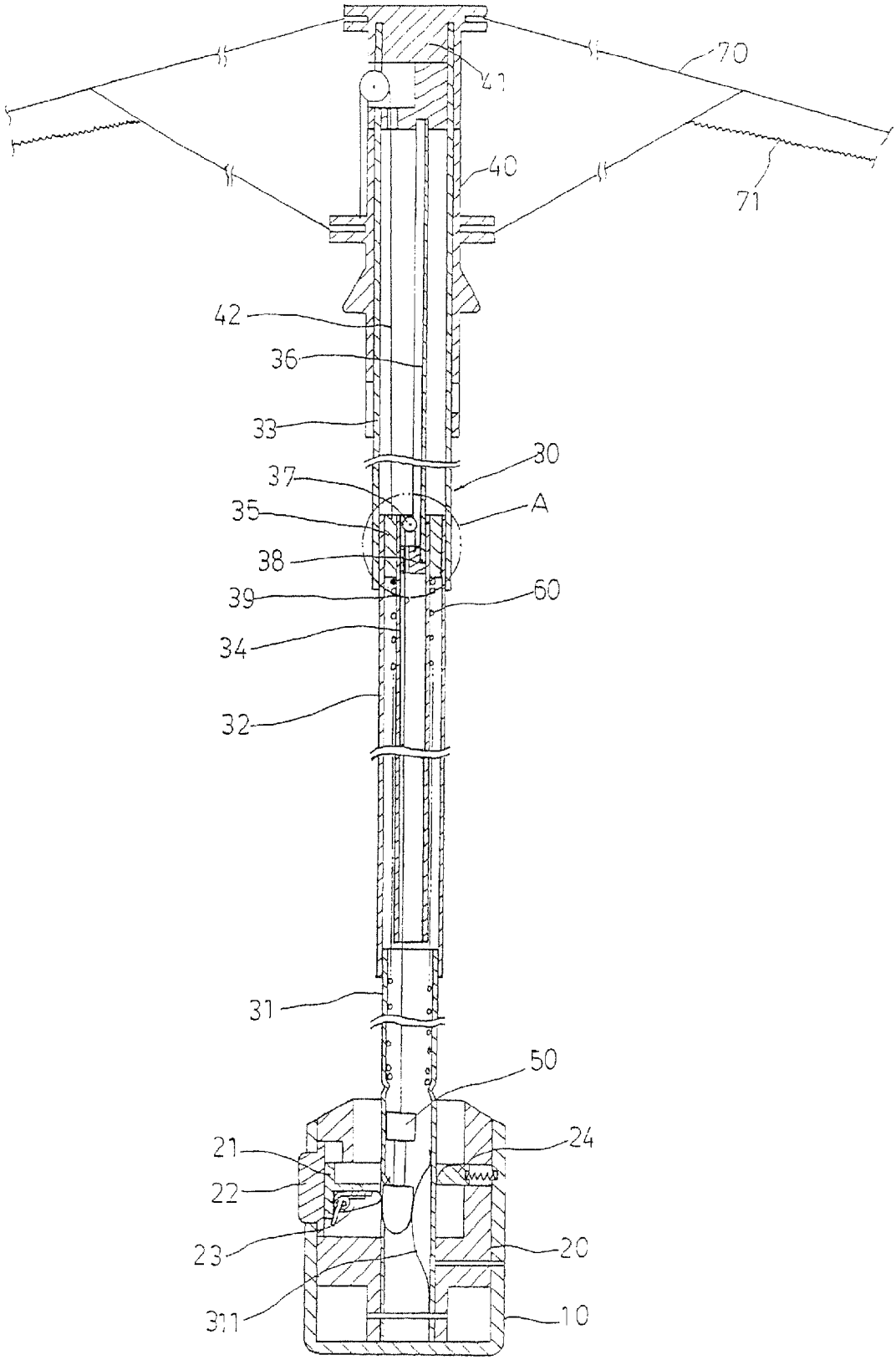
FIG. 2 is a cross-sectional view of the umbrella according to the present invention in an open condition.
Figure 4:
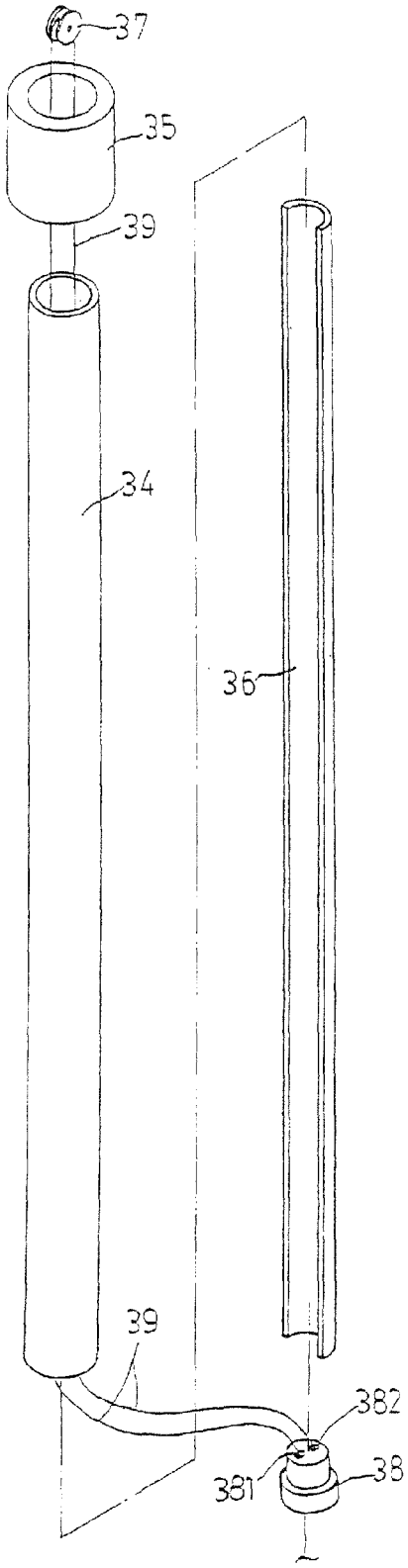
FIG. 4 is a partial exploded view of a shaft assembly according to the present invention.
Figure 5:
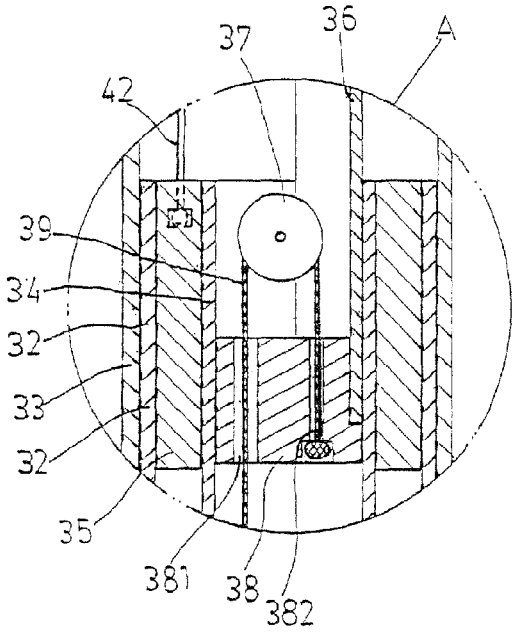
FIG. 5 is an enlarged view of circled portion A of FIG. 2.

Referring to FIGS. 2, 4, and 5, the present invent features the structure of the shaft assembly (30) of the umbrella, which is structured in such a way that an internal plug (35) is fixed to the top end of a second shaft section (32) and an inner tube (34) has a top end fixed to the internal plug (35). The internal plug (35) has a top end to which an end of a runner cable (42) is attached. An opposite end of the runner cable (42) extends upward and wraps around a pulley arranged inside the top cap (41) to extend outward for attaching to a top end of the runner (40). The inner tube (34) receives therein an operation tube (36), and the operation tube (36) has a top end fixed to a bottom of the top cap (41). The operation tube (36) has a bottom end that is fit into and fixed to an operation plug (38) in which a through hole (381) and a fixing hole (382) are formed. The inner tube (34) has a top portion receiving and retaining therein a pulley (37) around which an operation cable (39) wraps in such a way that an end of the operation cable (39) extends through the through hole (381) to attach to a top of the bullet-like member (50) and an opposite end is received and fixed in the fixing hole (382) to thereby attach to the operation plug (38).

Referring back to FIG. 1, the automatic umbrella is shown in a condition of being compressed and ready to use. The expansion spring (60) contained in the shaft assembly (30) is depressed by the internal plug (35) of the second shaft section (32) and shows a compressed condition. The runner (40) is caught and retained in position by the projecting bar (24) of the control ring (21). At the same time, the control bar (23) is depressed downward by the shaft assembly (30) to show an inclined condition. The bullet-like member (50) is depressed by the inner tube (34) and biased by the spring plate (311) to engage and thus retain in a retention hole formed in the first shaft section (31).

Referring to FIG. 2, to open the umbrella, the push button (22) is pressed down and the control ring (21) is thus pushed inward to separate the projecting bar (24) from the runner (40), whereby the spring force of the expansion spring (60) contained in the shaft assembly (30) forcibly drives the second shaft section (32) upward. At this moment, the bullet-like member (50) is stilled retained in the retention hole of the first shaft section (31), so that the operation cable (39) and the pulley (37) together move the operation tube (36) upward to push up the top cap (41) thereby moving the third shaft section (33) upward. Under this condition, the runner (40) is pulled upward by the runner cable (42) to expand the ribs (70) thereby completing automatic opening of the umbrella. It is noted that under this condition, the collapse spring (71) of each of the ribs (70) is set in an elongated condition. Further, the control bar (23) is allowed to move to a horizontal condition and engage the bullet-like member (50).

Figure 3:
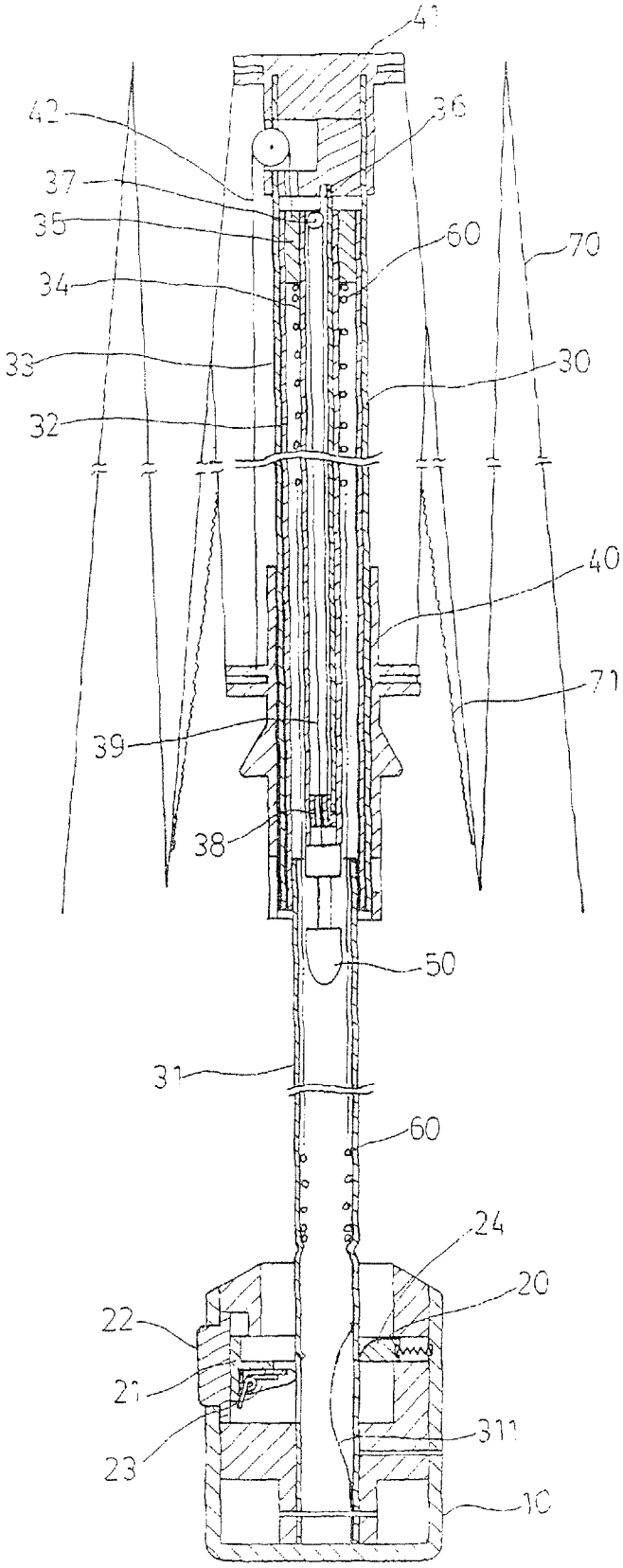
FIG. 3 is a cross-sectional view of the umbrella according to the present invention in a closed condition.

Referring to FIG. 3, to close the umbrella, the push button (22) is pressed again so that the control bar (23) pushes the bullet-like member (50) away to disengage from the retention hole of the first shaft section (31). Under this condition, the force induced by the operation cable (39) is removed so that the spring forces of the collapse springs (71) of the ribs (70) cause the ribs (70) and the umbrella canopy to collapse together and force the runner (40) to move downward and at the same time make the third shaft section (33) telescoping downward over the second shaft section (32). Consequently, the expanded the shaft assembly (30) is now turned into a length of only two sections. This allows the subsequent operation of closing the umbrella to be carried out in an easier and more efficient manner.

The above description of the structure of shaft of automatic umbrella is made with respect to an illustrative example of a three-fold umbrella. However, it is apparent that the structure of shaft according to the present invention is equivalently applicable to a four-fold or five-fold automatic umbrella, where the fourth section and/or fifth section of the shaft are telescopically coupled below the second section of the shaft.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A shaft of automatic umbrella, wherein the umbrella comprises a handle and an operation and control unit that is received in the handle and comprises a push button and a control ring that comprises a control bar and a projecting bar, a shaft assembly comprising a first shaft section, a second shaft section, and a third shaft section telescopically received in each other, a top cap fixed to a top end of the third shaft section, a runner movably fit over the shaft assembly, a bullet-like member arranged inside the shaft assembly, an expansion spring, and a plurality of ribs that is coupled between the top cap and the runner and each comprises a collapse spring; the improvement comprising that the shaft assembly is structured to comprise an internal plug received and fixed inside a top portion of the second shaft section and an inner tube received in the second shaft section and having a top end fixed to the internal plug, the internal plug having a top end to which an end of a runner cable is attached, the runner cable having an opposite end extending upward and wrapping around a pulley arranged inside the top cap to extend outward for attaching to a top end of the runner, the inner tube receiving therein an operation tube that has a top end fixed to a bottom of the top cap, the operation tube having a bottom end that is fit into and fixed to an operation plug in which a through hole and a fixing hole are formed, the inner tube having a top portion receiving and retaining therein a pulley around which an operation cable wraps in such a way that an end of the operation cable extends through the through hole to attach to a top of the bullet-like member and an opposite end is received and fixed in the fixing hole to attach to the operation plug.

2. The shaft of automatic umbrella according to claim 1, wherein the inner tube receives therein a smooth pin to replace the pulley.

3. The shaft of automatic umbrella according to claim 1, which is applicable to a four-fold or five-fold automatic umbrella, wherein a fourth section or a fifth section of the shaft assembly is telescopically coupled below the second shaft section.

* * * * *